US007382910B2

(12) United States Patent
Donders

(10) Patent No.: US 7,382,910 B2
(45) Date of Patent: Jun. 3, 2008

(54) METHOD OF ANALYSING A STACK OF FLAT OBJECTS

(75) Inventor: Paulina Theodora Gerarda Donders, Venlo (NL)

(73) Assignee: Syntech Holdings B.V., Venlo (NL)

( * ) Notice: Subject to any disclaimer, the term of this patent is extended or adjusted under 35 U.S.C. 154(b) by 528 days.

(21) Appl. No.: 10/520,735

(22) PCT Filed: Dec. 24, 2003

(86) PCT No.: PCT/NL03/00943

§ 371 (c)(1),
(2), (4) Date: Jan. 10, 2005

(87) PCT Pub. No.: WO2004/059585

PCT Pub. Date: Jul. 15, 2004

(65) Prior Publication Data

US 2006/0067559 A1 Mar. 30, 2006

(30) Foreign Application Priority Data

Dec. 24, 2002 (NL) ..... 1022257

(51) Int. Cl.
*G06K 9/00* (2006.01)

(52) U.S. Cl. ..... 382/135

(58) Field of Classification Search ..... 382/135–137, 382/194; 250/222.1; 414/901; 209/534; 356/71

See application file for complete search history.

(56) References Cited

U.S. PATENT DOCUMENTS

| | | | | |
|---|---|---|---|---|
| 4,694,474 | A * | 9/1987 | Dorman et al. | 377/6 |
| 4,878,626 | A * | 11/1989 | Leuthold et al. | 241/57 |
| 5,040,196 | A * | 8/1991 | Woodward | 377/8 |
| 5,324,921 | A * | 6/1994 | Takarada et al. | 235/98 R |
| 5,534,690 | A * | 7/1996 | Goldenberg et al. | 250/222.1 |
| 5,986,457 | A * | 11/1999 | Kayani | 324/671 |
| 6,182,962 | B1 * | 2/2001 | Leuthold | 271/152 |
| 6,351,552 | B1 * | 2/2002 | Weaver et al. | 382/135 |
| 6,874,611 | B2 * | 4/2005 | Lundblad | 194/209 |
| 7,103,206 | B2 * | 9/2006 | Graves et al. | 382/135 |
| 7,201,340 | B2 * | 4/2007 | Dietrich et al. | 241/101.2 |
| 2004/0213448 | A1 * | 10/2004 | Jou et al. | 382/135 |

FOREIGN PATENT DOCUMENTS

| | | |
|---|---|---|
| EP | 0 743 616 | 11/1996 |
| WO | WO 01/50426 | 7/2001 |

* cited by examiner

*Primary Examiner*—Andrew W. Johns
*Assistant Examiner*—Andrae Allison
(74) *Attorney, Agent, or Firm*—Roberts & Roberts, LLP

(57) ABSTRACT

A method of analyzing a bundle of banknotes. The method includes the steps of providing a bundle of banknotes, which bundle comprises at least one surface defined by the edges of banknotes, illuminating the surface of said bundle, providing a two-dimensional image of the bundle by making use of an optical sensor, and providing an output signal that represents the result of the analysis.

17 Claims, 1 Drawing Sheet

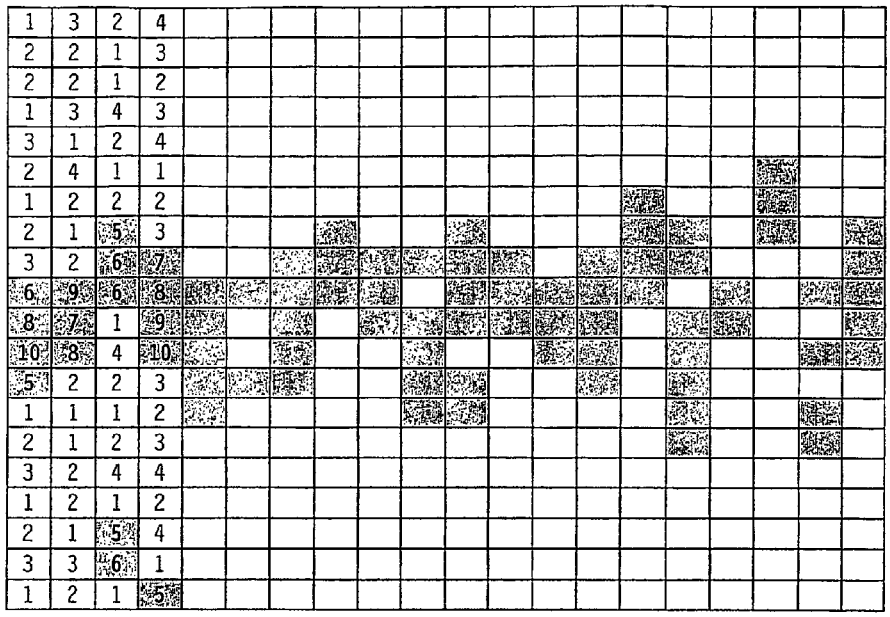

| | | | | | | | | | | | | | | | | | | | |
|---|---|---|---|---|---|---|---|---|---|---|---|---|---|---|---|---|---|---|---|
| 1 | 3 | 2 | 4 | | | | | | | | | | | | | | | | |
| 2 | 2 | 1 | 3 | | | | | | | | | | | | | | | | |
| 2 | 2 | 1 | 2 | | | | | | | | | | | | | | | | |
| 1 | 3 | 4 | 3 | | | | | | | | | | | | | | | | |
| 3 | 1 | 2 | 4 | | | | | | | | | | | | | | | | |
| 2 | 4 | 1 | 1 | | | | | | | | | | | | | | | | |
| 1 | 2 | 2 | 2 | | | | | | | | | | | | | | | | |
| 2 | 1 | 5 | 3 | | | | | | | | | | | | | | | | |
| 3 | 2 | 6 | 7 | | | | | | | | | | | | | | | | |
| 6 | 9 | 6 | 8 | | | | | | | | | | | | | | | | |
| 8 | 7 | 1 | 9 | | | | | | | | | | | | | | | | |
| 10 | 8 | 4 | 10 | | | | | | | | | | | | | | | | |
| 5 | 2 | 2 | 3 | | | | | | | | | | | | | | | | |
| 1 | 1 | 1 | 2 | | | | | | | | | | | | | | | | |
| 2 | 1 | 2 | 3 | | | | | | | | | | | | | | | | |
| 3 | 2 | 4 | 4 | | | | | | | | | | | | | | | | |
| 1 | 2 | 1 | 2 | | | | | | | | | | | | | | | | |
| 2 | 1 | 5 | 4 | | | | | | | | | | | | | | | | |
| 3 | 3 | 6 | 1 | | | | | | | | | | | | | | | | |
| 1 | 2 | 1 | 5 | | | | | | | | | | | | | | | | |

*FIGURE*

METHOD OF ANALYSING A STACK OF FLAT OBJECTS

BACKGROUND OF THE INVENTION

1. Field of the Invention

The present invention relates to a method of analyzing a stack of flat objects as well as to a device for analyzing a stack of flat objects. The present invention in particular pertains to a device and a method of analyzing a bundle of banknotes, which method comprises the steps of providing a bundle of banknotes, which bundle comprises at least one surface defined by the edges of banknotes, illuminating the surface of said bundle, providing a two-dimensional image of the bundle by making use of an optical sensor, and providing an output signal that represents the result of the analysis.

2. Description of the Related Art

From International application WO01/50426 there is known a method of determining a characteristic of a banknote including a sheet-like substrate of plastics material and pacifying layers applied to the two outer surfaces of the substrate. The method that is known therefrom comprises die steps of irradiating the substrate, the opacifying layers acting to guide the radiation "within" the substrate, whereupon the emission at the "end" of the substrate is detected, after which one or more characteristics of the emission, such as the intensity or the wavelength, are analyzed. The method described in said International application is only suitable for so-called "polymer banknotes", because the light bean must be trapped in the substrate.

From U.S. Pat. No. 6,182,962 there is known a method of separating a single note from a stack of banknotes, wherein the thickness of the stack is determined by means of a density sensor. The density is claimed to be a measure of the pressure with which the stack of banknotes is pressed against a withdrawal means. The method that is known therefrom is aimed at removing a single banknote from a stack of banknotes; the stack of banknotes as a whole is not analysed as such, however.

The method referred to in the introduction is also known from U.S. Pat. No. 5,534,690 (corresponding European patent No. 0 805 992). The method of counting stacked banknotes that is known therefrom requires the use of at least one optical sensor, which images at least two separate columns simultaneously along at least one surface of the bundle of banknotes, said columns extending in a direction perpendicular to the surface of the banknotes. On the basis of the signal provided by the optical sensor, a perception of the number of banknotes in the stack is obtained, for example by comparing the two images. One drawback of such a method is the fact that the bundle of banknotes must be subjected to so-called column imaging at two different positions. If the bundle contains folded, torn or strongly creased banknotes, this will render the result inaccurate.

From U.S. Pat. No. 5,918,960 there is known a method wherein a single banknote is illuminated with ultraviolet light of two different wavelengths, wherein detectors are used for detecting reflected light from the banknote having a first wavelength within a first wavelength band and for detecting fluorescence light from the banknote having a second wavelength within a second wavelength band different from said first wavelength band, said second wavelength band including wavelengths at which counterfeit objects may fluoresce when exposed to said ultraviolet light. Such a method is only limited to verifying authenticity characteristics of a single banknote, which means that if a large amount of banknotes is to be verified, each banknote must be separately subjected to such a verification of authenticity characteristics.

Banknotes include authenticity characteristics which may vary with each individual country, region or zone from a few authenticity characteristics in some banknotes to more than twenty authenticity characteristics in the Euro banknotes, for example. Such authenticity characteristics enable the user, the commercial financial institutions and the Central Banks to determine the authenticity of a banknote at different levels. Authenticity verification generally takes place upon acceptance of banknotes. At Central Banks, the verification of the authenticity characteristics of banknotes is carried out by means of so-called banknote sorting machines, with so-called "single note" sorting taking place. This means that all banknotes, which are usually supplied in bundles of 100, 500 or 1000 units, must first be "unbundled", which is a cost-intensive operation. Subsequently, the unbundled banknotes are mechanically verified one by one, irrespective of their value or their physical condition, by means of so-called sorting machines which carry the banknotes past a series of detectors and sensors. The verification comprises a number of authenticity checks, which can be carried out by means of a machine, as well as all kinds of measurements for determining the present condition or the fitness for use of the banknotes.

Low-denomination banknotes constitute about 40% of the total volume of banknotes that is in circulation worldwide. The "single note" sorting process as described above does not provide a desirable solution for handling low-denomination banknotes, in view of the high sorting costs and the (frequently) poor condition of these banknotes. Moreover, the efficiency of the sorting machine will strongly decrease if the physical condition of the banknotes to be processed is poor. The quality of low-denomination banknotes is generally inferior to that of high-denomination banknotes. This means that the handling costs of lower denomination banknotes are disproportionately high in relation to the value that such banknotes represent. In addition, low-denomination banknotes are rarely counterfeited, so that the high sorting costs will outweigh the security risk.

SUMMARY OF THE INVENTION

The object of the present invention is thus to provide a method and a device for analyzing banknotes, which method makes it possible to carry out the processing of banknotes at a high speed and with great precision.

Another object of the present invention is to provide a method and a device for analysing banknotes, which make it possible to process low-denomination banknotes at low cost.

BRIEF DESCRIPTION OF THE DRAWINGS

FIG. 1 shows a raster which comprises a section measuring 0.08 mm in vertical direction and 1.5 mm in horizontal direction of a transition between two banknotes, in which 20×20 pixels having pixel densities of 1-10 are arranged.

DETAILED DESCRIPTION OF THE INVENTION

The present invention as referred to in the introduction is characterized in that the provision of the two-dimensional image is carried out in such a manner that the image is enlarged in the y-direction, which y-direction is defined as the height of the bundle of banknotes.

In a special embodiment, the image is reduced in the x-direction, which x-direction is to be considered as the width of the bundle of banknotes.

One or more of the above objects will be accomplished by using such a method, wherein a so-called anamorphous image is produced of one side of the total bundle of banknotes.

A banknote can be considered to be a rectangular, flat object having an upper side and a lower side, bounded by four sides or edges, two long sides or edges and two short sides or edges. The anamorphous image may be produced both of the short side and of the long side. The term "height" is understood to mean the distance or length of the bundle of banknotes that depends on the number of banknotes contained in the bundle or stack. When the number of banknotes increases, the "height", or the length in the y-direction, will increase proportionally, whilst the width, or the length in the x-direction, remains the same, which width is to be considered the dimension of the short or long sides of a banknote. Using the present invention, the bundle of banknotes can therefore be analysed either in a horizontal position (upper side and lower side parallel to the supporting surface) or in an upright position (upper side and lower side perpendicular to the supporting surface) on a supporting surface.

Preferably, the step of providing the two-dimensional image of the bundle and obtaining an output signal comprises the step of carrying out an image processing operation, using a pixel matrix, in particular the provision of a pixel matrix in which the number of pixels in the y-direction is larger than the number of pixels in the x-direction.

In order to obtain a high degree of precision in the analysis, the number of pixels in the y-direction is preferably at least 3 times, preferably 5 times, larger than the number of pixels in the x-direction, more particularly, the number of pixels in the y-direction is preferably at least 10 times larger than the number of pixels in the x-direction.

The step of carrying out the image processing operation comprises the steps of awarding a value corresponding to the optical density to a pixel, determining a threshold value of the optical density, awarding a priority to a pixel having an optical density value higher than the threshold value while making use of the so-called second derivative of the density profile of the surrounding pixels, determining an average value of the density for a row of pixels in the y-direction, which row comprises one or more pixels having a priority, determining the spread and the standard deviation of the average value thus determined, and providing an output signal which is the summation of the number of average values higher than the threshold value. This manner of analysing will be explained in more detail yet in the present description. The term "second derivative" is understood to mean the determination of the change (the increase/decrease of the density value of a pixel and the surrounding pixels). The term "first derivative" is to be understood to mean the determination of the maximum/minimum.

A special method of analysing is a method in which the bundle of banknotes remains mechanically intact. In fact this means that the bundle of banknotes does not undergo a destructive operation, so that the bundle of banknotes is suitable for recirculation, for example, after being subjected to such an analysis.

In a specific embodiment it may be preferable, however, to carry out the analysis in such a manner that the bundle is subjected to one or more destructive operations. In certain embodiments, on the other hand, the analysis preferably comprises a combination of leaving the bundle mechanically intact and performing destructive operations thereon.

Such a destructive operation may for example consist of subjecting one or more sides of the bundle of banknotes to a mechanical operation, such that one or more clean surfaces are obtained, which clean surfaces are used in analysing the bundle of banknotes. A so-called clean cut surface may be formed on the bundle of banknotes, for example by means of a cutting element, which clean cut surface is a cross-section of the bundle of banknotes. Subsequently, a number of characteristics of the bundle of banknotes and of the individual banknotes contained therein can be determined on the basis of said cross-section. If the dimension of the bundle of banknotes thus cut remains within the tolerances that apply, the cut banknotes are suitable for being put into circulation again.

In the present description, the analysis comprises the determination of one or more of the following parameters the authenticity, the number of banknotes, the value and the fitness of the bundle of banknotes.

The determination of the authenticity of the bundle of banknotes may comprise the performing of a destructive operation on one or more sides of the bundle of banknotes, so that one or more clean surfaces are obtained, wherein the cut surface is irradiated with UV light. Since banknotes generally contain cotton fibres or cotton fluff as a raw material, the absence of fluorescence under UV light will generally constitute an authenticity characteristic. In a special embodiment it is also possible, on the other hand, to apply a line of iodine to the cut surface of the bundle of banknotes, in which case a brown discolouration will indicate that the substrate to which the iodine has been applied is a starch-glued paper. Such a result means that the banknote is counterfeit, because a cotton substrate will not exhibit any discolouration when treated with iodine. A number of compounds may be used for colouring a cotton basic material, such as calcium nitrate, magnesium chloride and zinc chloride.

Said authenticity determination may also take place by irradiating one side of the bundle of banknotes with infrared radiation, the side to be irradiated preferably being a cut surface obtained by a destructive operation.

According to another embodiment, it is desirable to obtain an image of one side of the bundle of banknotes, using a high-resolution camera, which image is processed, using a suitable data processing unit, for the purpose of determining the origin and/or the authenticity of the bundle. It is also possible, however, to determine the authenticity through measurement of the E-modules of the banknotes, the determination of the presence of a so-called marker that reacts to x-ray fluorescence.

A large number of banknotes is provided with a so-called security filament in the substrate. When a bundle of banknotes has been subjected to a destructive operation, for example by forming a cut surface, the security filament will be centrally positioned in the substrate, seen in sectional view, and can thus the detected in sectional view but not in plan view. The presence of such a security filament is verified by inspecting the cut surface, using a so-called high-resolution or CCD-camera in combination with a recognition algorithm.

If a bundle of banknotes has undergone a destructive operation, such as the forming of a cut surface, it is possible to obtain an image of one side of a bundle of banknotes, using a high-resolution camera, which image is processed, using a suitable data processing unit, so as to determine the number of banknotes contained in a bundle of banknotes. A denomination determination may also take place by heating the security filament present in banknotes, using microwave radiation, and subsequently analysing the infrared spectrum.

Using a high-resolution camera or a so-called CCD-camera, it is possible to register the banknote paper/air transitions, which transitions are analysed and quantified via a recognition algorithm. Said recognition algorithm relates the fitness of the banknotes to the dimensions of the space and the transitions between the individual banknotes in the bundle. In a special embodiment, the determination of the number of banknotes in a bundle of banknotes may be carried out in such a manner that the bundle of banknotes remains mechanically intact, in which case the number of banknotes is determined by irradiating the bundle with far infrared (THz) light from various directions and subsequently registering the reflection of a short THz pulse as a function of time.

In order to be able to determine the value of a bundle of banknotes, it is possible in a special embodiment to obtain an image of one side of a bundle of banknotes, using a high-resolution camera, which image is processed, using a suitable data processing unit, wherein the bundle of banknotes has undergone a destructive operation, in particular the forming of a cut surface.

Using such a high-resolution camera, in particular a so-called CCD-camera, differences in the optical density in the section are registered, and it can be determined by means of a recognition algorithm whether the banknotes have the correct denomination.

Preferably, the compressibility of a bundle of banknotes is measured for the purpose of determining the fitness of a bundle of banknotes.

Said fitness in fact depends on the number of creases or folds in a banknote, and the present applicant has found that the height of a stack of dirty and creased banknotes is greater than the height of a stack of uncirculated, clean banknotes. Thus it is possible to determine the fitness of a bundle of banknotes by measuring the compressibility thereof.

In a special embodiment it is also possible, however, to determine the average fitness of a bundle of banknotes by measuring the acoustic resistance of a bundle of banknotes, in which case a soundwave is passed through the bundle of banknotes at various positions.

In a specific embodiment, it is furthermore preferable to determine the fitness of an individual banknote or of a number of banknotes together on the basis of the propagation of soundwaves in such a banknote or number of banknotes. Using reflection and transmission measurements at different intensity values and at different positions through a bundle of banknotes, it has appeared to be possible to localise the maximum acoustic resistance value. Said maximum value is an indication of the largest volume of air inclusions, which corresponds to banknotes having the highest number of creases and folds, therefore. Thus a so-called ultra-sound wave is generated in a bundle of banknotes, with the velocity and attenuation of said wave being determined by the mechanical properties of the bundle of banknotes. Thus, a non-destructive examination of a bundle of banknotes can be made for the purpose of determining the fitness thereof.

It is also possible, however, to subject a bundle of banknotes to a destructive operation, such that a so-called cut surface is obtained, in which case a sound pulse is generated on such a cut surface by means of a laser pulse and the propagation velocity of such a pulse in the banknote can be precisely determined, the magnitude thereof being an indication of the authenticity of the bank-paper. It should be noted, however, that said propagation velocity has a maximum value in the case of new, uncirculated banknotes. Circulation will cause the banknotes to crease and exhibit a less dense fibre structure. Thus, the propagation velocity will decrease and the measured value of the propagation velocity of ultra-sound is thus a measure of the fitness of the banknote.

The present invention further relates to a device for analysing a bundle of banknotes, which bundle comprises at least one surface defined by the edges of the banknotes, said device comprising a light source for illuminating said surface, at least one optical sensor for providing a two-dimensional image, an image processing unit for processing a two-dimensional image, and providing an output signal that represents the result of the analysis, characterized in that the optical sensor provides a two-dimensional image which is enlarged in the y-direction, which y-direction is defined as the height of the bundle of banknotes.

It is in particular preferable for the two-dimensional image to be reduced in the x-direction, which x-direction is to be considered as the width of the bundle of banknotes. The present device may function in line with a sorting machine, a disintegrator or as a stand-alone machine.

In a special embodiment, the optical sensor preferably comprises a number of individual optical sensors, which optical sensors each receive a segment of the illuminated bundle of banknotes, wherein use is made a mirror construction, which mirror construction is in particular made up of a number of submirrors, in particular a semi-transparent mirror.

In order to prevent inaccuracies and undesirable curvatures, the sensors are preferably individually movable in the x-, y- and z-directions. In addition to that, the optical sensor may be a scanning camera, which scanning camera carries out a scanning of the bundle of banknotes in the x-direction.

In order to obtain a so-called cut surface, it is furthermore preferable for the device to comprise a cutting element, which removes an amount of material from a bundle of banknotes in a plane perpendicular to the z-direction, which cut surface of the bundle of banknotes acts is used as the surface to be illuminated or irradiated in the illuminating step. The quality of the cut surface is related to the sharpness of the cutting element. An increasing gleam of the cut surface is an indication of a decreasing quality of the cutting element. In specific embodiments it is desirable, therefore, to use means for measuring the gleam, such as a gleam indicator.

In the case of an anamorphous image, the scale of the image is different in the x- and y-directions. When the number, the authenticity, the fitness and the denomination is to be determined via the short side of a bundle of banknotes, it is of primary importance to examine the properties of the substrate and the transitions between the individual banknotes. The height of the banknotes is less important. An anamorphous image of the short side makes it possible to display the bundle on a larger scale in the y-direction (and thus to award a great deal more pixels to the thickness of the individual banknotes in the image) and on a smaller scale in the x-direction.

The principle of the anamorphous image for the inspection of the short side (or the long side) of the bundle will be explained below.

The bundle to be examined (the banknotes are in a horizontal position), which has a height associated with 100, 500 or 1000 banknotes, is clamped down in a frame, and the optical sensor scans the short side of the bundle. Illuminating means provide diffuse illumination of said side. The lens construction that follows projects said side on a row of sensors.

It is desirable to gather a great deal of information about the thickness of the banknotes and the transitions between said banknotes. Empirical data indicate that about 25 pixels are required for displaying 0.1 mm—the thickness of the banknote. The short side of a bundle of 500 banknotes has a height of about 60 mm and a width of about 75 mm. In vertical direction, said 60 mm must comprise about 12,500 pixels (500×25), and in horizontal direction said 75 mm must be reduced to about 1000 pixels. Taking into account pixel dimensions in the order of 7×7 μm, this means an enlargement from 60 mm to 87.5 mm (factor 1.45) and a reduction from 75 mm to 7 mm (factor 0.09). The anamorphous image proportion is nearly 16 in that case. The short side is reduced in horizontal direction, for example by means of two cylinder lenses, enlarged in vertical direction and subsequently projected on a sensor. A division into a number of sensors (for example more than 12) of 1000×1000 pixels each is desirable.

A submirror provides a division of the projected image on the sequentially arranged sensors. The term sequentially arranged is understood to mean that the upper 10 mm of the short side are for example projected on the left-hand top sensor, the second 10 mm on the right-hand top sensor, the third 10 mm on the middle sensor, etc. The sensors can be individually moved with great precision, and they are mechanically adjusted with respect to each other and with respect to the bundle. The movement may take place in the x-, y- and z-directions. Furthermore, the sensors can be rotated through a small angle so as to offset the slight curvature of the display surface.

The anamorphous image thus comprises an image of the short side of the bundle. Of course it is also possible—if necessary—to provide an image of the long side of the bundle.

In the case of an enlargement factor <2, depth of field problems caused by differences in the dimensions of individual banknotes are controllable. If the bundle contains banknotes of such a poor quality that it is difficult to obtain a sharp or focussed image of the side, the bundle the may be cut and be provided with a clean cut surface. The snippets thus formed are blown or suctioned away by suction means disposed between the bundle and the illuminating element. Said cutting is done in steps of e.g. 0.25 mm each. The banknotes may be put into circulation again if the number of steps remains within the cutting tolerance of the banknotes. It stands to reason that if the number of steps exceeds said cutting tolerance, the banknotes cannot be put into circulation again, that is, they will subsequently have to be destroyed. The quality of the cut surface is directly related to the sharpness of the cutting element, such as a knife. An increase in the gleam of the cut surface indicates a decreasing quality of the knife; in other words, a gleam indicator functions to monitor the quality of the knife.

According to another method of obtaining an image comprising about 12,500 pixels in vertical direction and about 1000 pixels in horizontal direction, the bundle is scanned, with the height of the short side of the bundle being enlarged on a line sensor of 12,500 pixels. It is desirable to subsequently scan the bundle in horizontal direction in steps of about 75 μm. It is also possible to project a reduced bundle width on a line sensor of 1000 pixels and subsequently scan the bundle in vertical direction in steps of less than 5 μm. In view of this step size and the associated precision, scanning in horizontal direction is preferred.

Via the anamorphous high-resolution camera or the scan, the short side or the long side of the bundle is converted into a raster in which the number of pixels in the y-direction is much larger than in the x-ray-direction. The individual pixels have a signal value that corresponds to the optical density, and the number of banknotes is determined as follows via image processing of this raster of density. The raster that is shown in the Figure serves to explain the algorithm.

The Figure comprises a section measuring 0.08 mm in vertical direction and 1.5 mm in horizontal direction of a transition between two banknotes, in which 20×20 pixels having pixel densities of 1-10 are arranged.

The section is an example of a density distribution obtained from the sensors. A threshold value of e.g. 5 IS then set in this example. Other threshold values are also possible, of course. All densities 25 are shaded gray. Following that, pixels having a density Z5 and the surrounding n×m pixels are regarded. Of said surrounding n×m pixels, the density development in the x- and y-directions, and subsequently the gradient of said development, the second derivative, are determined. The pixels exhibiting the greatest gradient changes are interconnected. The horizontal line thus obtained indicates the division between two banknotes, and counting takes place by summing the number of horizontal lines. The maximum value for n in vertical direction is the number of pixels for each banknote thickness (a value of 25 pixels per banknote has been indicated before). The value for m (the horizontal number of pixels) is related to the number of dots of which the horizontal line is built up.

The line may be subjected to a further analysis before it may be included, in which analysis the bandwidth within which said line must range, the angular boundaries of the lines between the two successive interconnected pixels etc may be taken into account. The software must also take the number of incomplete lines, or the number of interconnections between the lines, etc into account. The provides a possibility of saying something about the reliability of the count. The subsequent refinement is to make the software self-learning.

Another method fo determining the number of banknotes contained in a bundle is to measure the reflection and the absorption of Terahertz radiation on individual banknotes in a bundle. Paper is relatively transparent to Terahertz radiation having a wavelength in the mm range.

If the image of the side of the bundle exhibits an insufficient contrast—for the measurement—the contrast may be enhanced by bending the bundle and/or colouring the side surface.

The invention claimed is:

1. A method of analyzing a bundle of banknotes, which method comprises the stops of providing a bundle of banknotes, which bundle comprises at least one surface defined by the edges of banknotes, subjecting the bundle to one or more destructive operations, illuminating the surface of said bundle, providing a two-dimensional image of the bundle by making use of an optical sensor, and providing an output signal that represents the result of the analysis, wherein according to said one or more destructive operations, one or more sides or edges of the bundle of banknotes is subjected to a mechanical operation, such that one or more clean surfaces are obtained, which clean surfaces are used in analyzing the bundle of banknotes.

2. The method according to claim 1, wherein the image is reduced in the x-direction, which x-direction is defined as the width of the bundle of banknotes.

3. The method according to claim 1 wherein the step of providing the two-dimensional image of the bundle and obtaining an output signal comprises the step of carrying out an image processing operation, using a pixel matrix.

4. The method according to claim 3, wherein the step of carrying out an image processing operation comprises the provision of a pixel matrix in which the number of pixels in the y-direction is larger than the number of pixels in the x-direction.

5. The method according to claim 4, wherein the number of pixels in the y-direction is at least 3 times larger than the number of pixels in the x-direction.

6. The method according to claim 4, wherein the number of pixels in the y-direction is preferably at least 5 times larger than the number of pixels in the x-direction.

7. The method according claim 3 wherein the step of carrying out the image processing operation comprises the steps of awarding a value corresponding to the optical density to a pixel, determining a threshold value of the optical density, awarding a priority to a pixel having an optical density value higher than the threshold value while determining a second derivative of the density profile of to surrounding pixels, determining an average value of the density for a row of pixels in the y-direction, which row comprises one or more pixels having a priority, determining the spread and the standard deviation of the average value thus determined, and providing an output signal which is the summation of the number of average values higher than the threshold value.

8. The method according to claim 1 wherein the analysis comprises the determination of one or more of the following parameters: the authenticity, the number of banknotes, the value and the fitness of the bundle of banknotes.

9. The method according to claim 1 wherein said irradiation with UV light is carried out on one side of a bundle of banknotes.

10. The method according to claim 1 wherein said irradiation with infrared light is carried out on one side of a bundle of banknotes.

11. The method according to claim 8 wherein an image of one side of the bundle of banknotes is obtained by making use of a high-resolution camera as an optical sensor, which image is processed, using a suitable data processing unit, for the purpose of determining the authenticity of the bundle.

12. The method according claim 8 wherein an image of one side of the bundle of banknotes is obtained by making use of a high-resolution camera as an optical sensor, which image is processed, using a suitable data processing unit, for the purpose of determining the number of banknotes in a bundle.

13. The method according to claim 8 wherein said determination of the number of banknotes in a bundle of banknotes is carried out by irradiating one side of the bundle with far infrared light at a number of angles of incidence and carrying out a time measurement on the reflected radiation.

14. The method according to claim 8 wherein an image of one side of the bundle of banknotes is obtained by making use of a high-resolution camera as an optical sensor, which image is processed, using a suitable data processing unit, for the purpose of determining the origin and/or the value of the bundle of banknotes.

15. The method according to claim 8, wherein the fitness of a bundle of banknotes is determined by measuring the compressibility of a bundle of banknotes.

16. The method according to claim 8, wherein the fitness of a bundle of banknotes is determined by measuring the acoustic resistance of a bundle of banknotes.

17. The method according to claim 1, wherein the providing of the two-dimensional image is carried out in such a manner that the image is enlarged in the y-direction, which y-direction is defined as the height of the bundle of banknotes.

* * * * *